US008678070B2

(12) United States Patent
Kimener

(10) Patent No.: US 8,678,070 B2
(45) **Date of Patent: *Mar. 25, 2014**

(54) SELF-ALIGNING DOOR JAMB TRACK

(71) Applicant: Rytec Corporation, Jackson, WI (US)

(72) Inventor: Thomas Terrance Kimener, Loveland, OH (US)

(73) Assignee: Rytec Corporation, Jackson, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/887,520

(22) Filed: May 6, 2013

(65) Prior Publication Data

US 2013/0240164 A1 Sep. 19, 2013

Related U.S. Application Data

(60) Continuation of application No. 13/309,663, filed on Dec. 2, 2011, now Pat. No. 8,439,101, which is a division of application No. 12/077,680, filed on Mar. 20, 2008, now abandoned.

(60) Provisional application No. 60/919,025, filed on Mar. 20, 2007.

(51) Int. Cl.
*E06B 9/17* (2006.01)

(52) U.S. Cl.
USPC ..... 160/271; 160/272; 160/266

(58) Field of Classification Search
USPC ..... 160/273.1, 266, 267.1, 271, 272; 49/198, 206, 414, 415, 440
See application file for complete search history.

(56) References Cited

U.S. PATENT DOCUMENTS

| | | | | |
|---|---|---|---|---|
| 5,219,015 | A * | 6/1993 | Kraeutler | 160/271 |
| 6,321,822 | B1 * | 11/2001 | Horner et al. | 160/194 |
| 6,722,416 | B2 * | 4/2004 | Varley et al. | 160/264 |
| 7,389,807 | B2 * | 6/2008 | Nagare et al. | 160/273.1 |
| 7,665,506 | B2 * | 2/2010 | Coenraets | 160/266 |
| 7,762,304 | B2 * | 7/2010 | La Marca et al. | 160/8 |
| 8,439,101 | B2 * | 5/2013 | Kimener | 160/271 |
| 2007/0277941 | A1 * | 12/2007 | Jansen et al. | 160/271 |
| 2012/0073206 | A1 * | 3/2012 | Kimener | 49/197 |

* cited by examiner

*Primary Examiner* — Blair M. Johnson
(74) *Attorney, Agent, or Firm* — Factory Intellectual Property Law Group, Ltd.

(57) ABSTRACT

A track for a roll-up industrial door. The track may include realigners adapted to divert the path of the industrial door as it is opened or shut. For example, a realigner may include a tapered portion to maintain a portion of the door within the track as the door is shut. Another realigner may have a tapered portion arranged to direct a portion of the door onto the track after it has been removed from the track. The tracks may be utilized in conjunction with a break-away industrial door having a flexible frame that is adapted to come out of the guide track upon application of a predetermined force.

19 Claims, 5 Drawing Sheets

SELF-ALIGNING DOOR JAMB TRACK

CROSS REFERENCE TO RELATED APPLICATIONS

This application is a continuation of U.S. patent application Ser. No. 13/309,663 filed Dec. 2, 2011, which is a divisional of U.S. patent application Ser. No. 12/077,680 filed Mar. 20, 2008, which claims the benefit of U.S. Provisional Application No. 60/919,025, filed Mar. 20, 2007—the contents of each of which are hereby incorporated by reference in their entirety.

BACKGROUND OF THE INVENTION

1. Field of the Invention

The instant invention is directed to vertical wall-mounted tracks that guide roll-up industrial doors, as well as roll-up industrial doors that are adapted to break away from the vertical track when contacted by a predetermined force.

2. Description of the Related Art

Conventional roll-up industrial doors often include vertical tracks for guiding the door during its upward and downward travel. These tracks may include a back wall and two perpendicular side walls arranged to form a C-shaped channel.

INTRODUCTION TO THE INVENTION

Exemplary embodiments of the present invention provide a track for a roll-up industrial door. The track may include realigners adapted to divert the path of the industrial door as it is opened or closed. For example, a realigner may include a tapered portion to maintain a portion of the door within the track as the door is closed. Another realigner may have a tapered portion arranged to direct a portion of the door onto the track after it has been removed from the track. The tracks may be utilized in conjunction with a break-away industrial door having a flexible frame adapted to come out of the guide track upon application of a predetermined force.

In a first aspect, a vertical jamb for an industrial door according to the present invention may include a first guide at least partially defining a longitudinal track, the first guide including a first guide length and a second guide length arranged substantially coaxially, the first guide length spaced apart from the second guide length to define a first discontinuity; a second guide mounted parallel to the first guide, the second guide at least partially defining the track; and a first realigner proximate the discontinuity for directing a portion of an industrial door outside of the track back into the track as the door is being retracted. The first realigner may include a surface that is obliquely angled with respect to the track and that is at least partially outside of the track.

In a detailed embodiment of the first aspect, the first guide may include a third guide length arranged substantially coaxially with respect to the first guide length and the second guide length, the third guide length spaced apart from the second guide length to define a second discontinuity. The track may further comprise a second realigner proximate the second discontinuity and the second realigner may include a surface that is obliquely angled with respect to the track and that is at least partially outside of the track. The vertical jamb may include a third realigner proximate the first discontinuity and a fourth realigner proximate the second discontinuity. The first realigner, second realigner, third realigner, and fourth realigner may each include a pair of non-parallel, obliquely angled segments extending from within the track to outside of the track.

In another detailed embodiment of the first aspect, the first realigner may be mounted to at least one of the first guide and a surface to which the first guide is mounted, and the first realigner may extend from an inner side of the first guide length, through the first discontinuity, and beyond an outer side of the first guide length. The first realigner may include a parallel portion mounted substantially parallel to the first guide. The vertical jamb may further include a second realigner proximate the first discontinuity. The angled portion of the first realigner may be arranged to direct the portion of the industrial door into the track when the industrial door is being retracted and the second realigner may include an angled portion arranged to direct the portion of the industrial door into the track when the industrial door is moving in a downward direction. The second realigner may include at least one end having a curved surface. The vertical jamb may further include a top guide for directing the portion of the industrial door into a top of the track when the industrial door is moving in a downward direction.

In a second aspect, an industrial door assembly according to the present invention may include an industrial door mounted to a roller and a pair of door jambs opposing one another, each of the door jambs including a vertical track defining a line of travel along which the industrial door travels, the vertical track comprising a first track section and a second track section arranged coaxially and parallel with the line of travel, the first track section spaced apart from the second track section to provide a first gap there between, and a third track section arranged parallel but not coaxially with the first track section and the second track section; a first realigner mounted proximate the first gap, the first realigner having a surface at least partially outside of the vertical track, the surface being obliquely angled with respect to the line of travel; a second realigner mounted proximate the first gap, the second realigner having a surface at least partially outside of the vertical track, the surface being obliquely angled with respect to the line of travel.

In a detailed embodiment of the second aspect, the first realigner may have a length greater than a length of the second realigner. The surface of the first realigner is oriented generally perpendicular to the surface of the second realigner.

In another detailed embodiment of the second aspect, the vertical track may further include a fourth track section spaced apart from the second track section to provide a second gap and a third realigner and a fourth realigner mounted proximate the second gap so that the third realigner directs the portion of the industrial door that has been removed from the vertical track into the vertical track during movement of the door in the first direction and the second realigner maintains the industrial door within the vertical track during movement of the industrial door in the second direction.

In yet another detailed embodiment of the second aspect, the vertical track may include a top realigner mounted to a top of the first track section, the top realigner having a diverging opening in an upward direction.

In a third aspect, a method of realigning a break-away industrial door within a channel according to the present invention may include the steps of providing a retractable break-away industrial door; providing a channel through which the industrial door vertically travels; providing at least one opening along the channel having at least one diverter mounted proximate the opening; and retracting the door so that at least a portion of the door removed from the channel contacts the diverter and is repositioned within the channel by continued retraction of the break-away door.

In a detailed embodiment of the third aspect, two diverters may be mounted proximate the opening, the first diverter forming an inverted Y-shape with a central channel and the second diverter forming an upright Y-shape with a central channel, the central channel of the first diverter and the central channel of the second diverter coinciding with the channel. The method may further include the step of lowering the break-away industrial door after the step of retracting the break-away door, the step of lowering the break-away industrial door including maintaining the break-away industrial door within the channel using the second diverter.

In another detailed embodiment of the third aspect, the step of providing at least one opening within the channel having at least one diverter may include providing at least two openings within the channel, each opening having at least one diverter mounted proximate the opening. Two diverters may be mounted proximate each opening.

DETAILED DESCRIPTION OF THE INVENTION

The exemplary embodiments of the present invention are described and illustrated below to encompass methods of continuing or reestablishing an industrial door within a vertical track after the door has been displaced from the vertical track, as well as apparatuses for continuing or reestablishing an industrial door within a vertical track after the door has been displaced from the vertical track. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention as defined by the claims.

Figure 1:
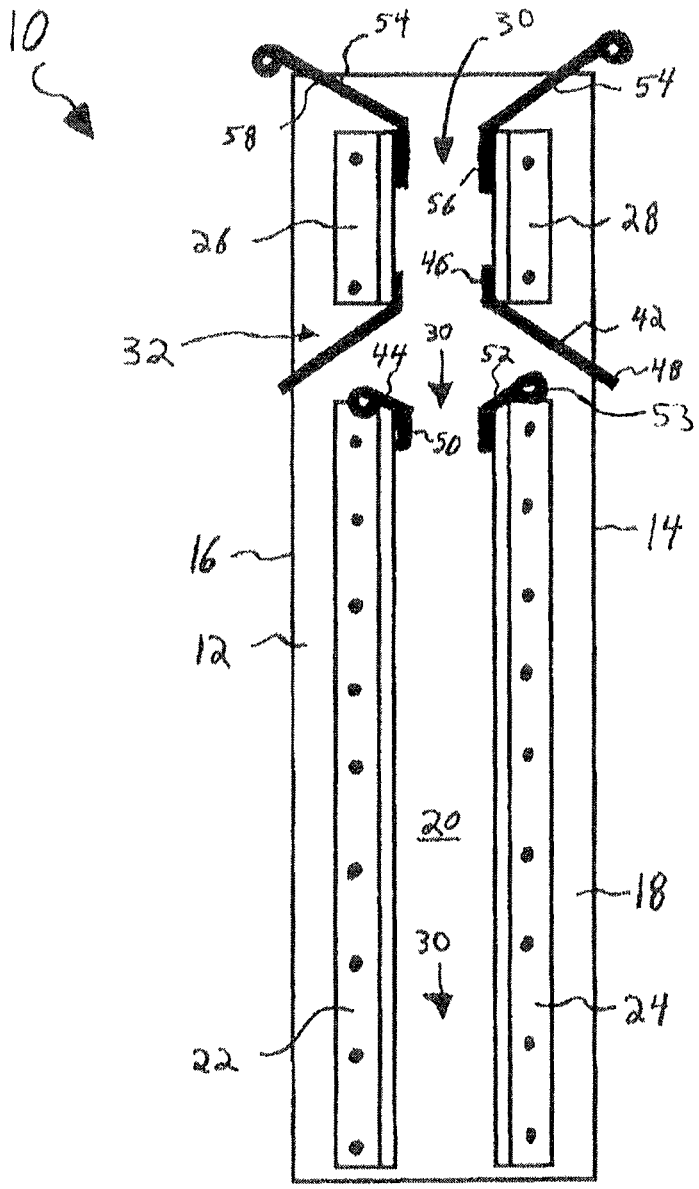
FIG. 1 is a frontal view of an exemplary door jamb fabricated in accordance with the present invention.
Figure 5:
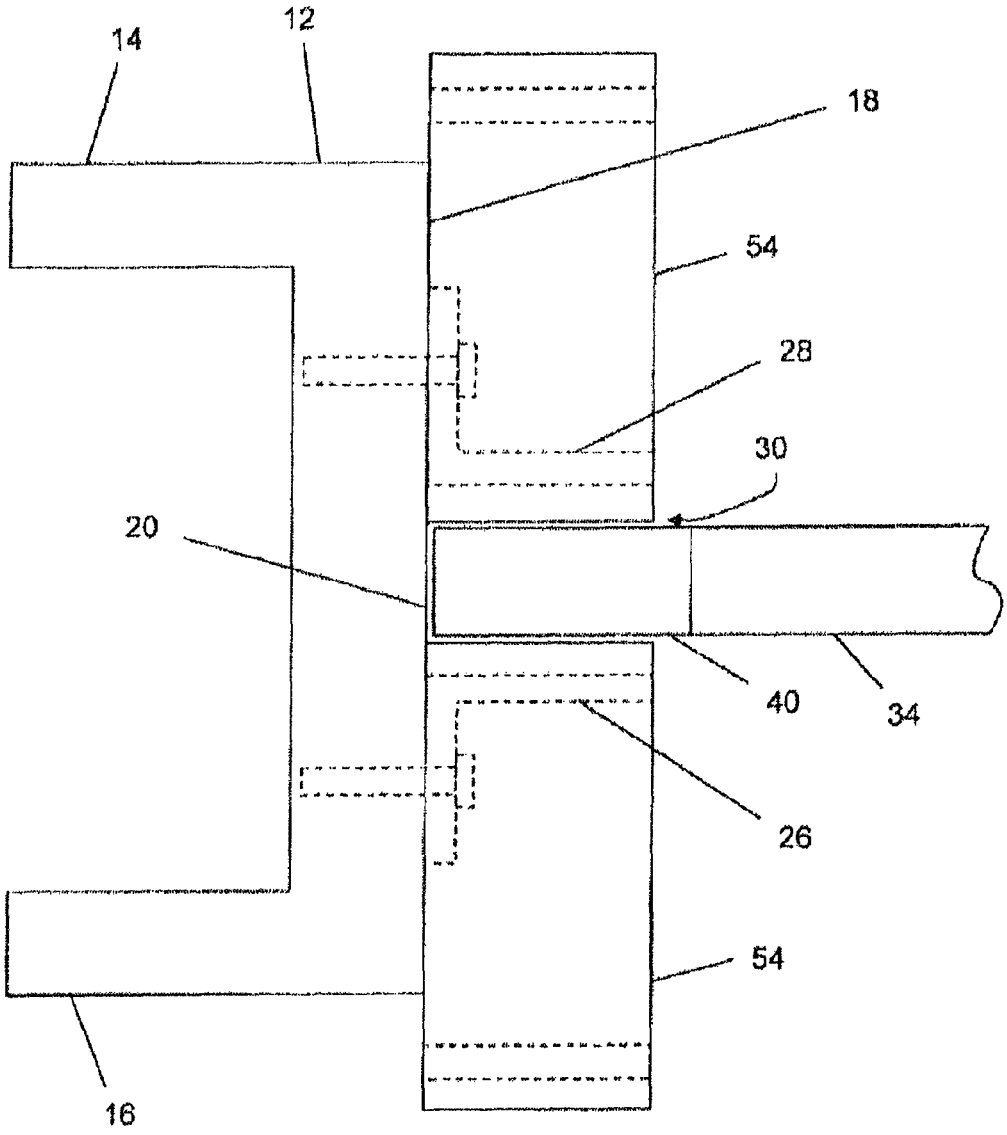
FIG. 5 is a plan view of an exemplary embodiment door jamb including a track.

Referring to FIGS. 1 and 5, an exemplary door jamb 10 in accordance with the instant invention includes a block C-shaped fiberglass platform 12 having opposed left and right sides 14, 16 and a center section 18 having an exposed surface 20 (see FIG. 5 in particular). The center section 18 provides a mounting substrate to which a plurality of right angled fiberglass brackets 22, 24, 26, 28 are mounted. In this exemplary embodiment, four right angled brackets 22, 24, 26, 28 are mounted to the center section 18 in a generally vertical orientation to partially define a vertical track 30 between opposed angled brackets 22, 24, 26, 28. Vertical space is left between the lower angled brackets 22, 24 and the upper angled brackets 26, 28 to provide a discontinuity 32.

Figure 2:
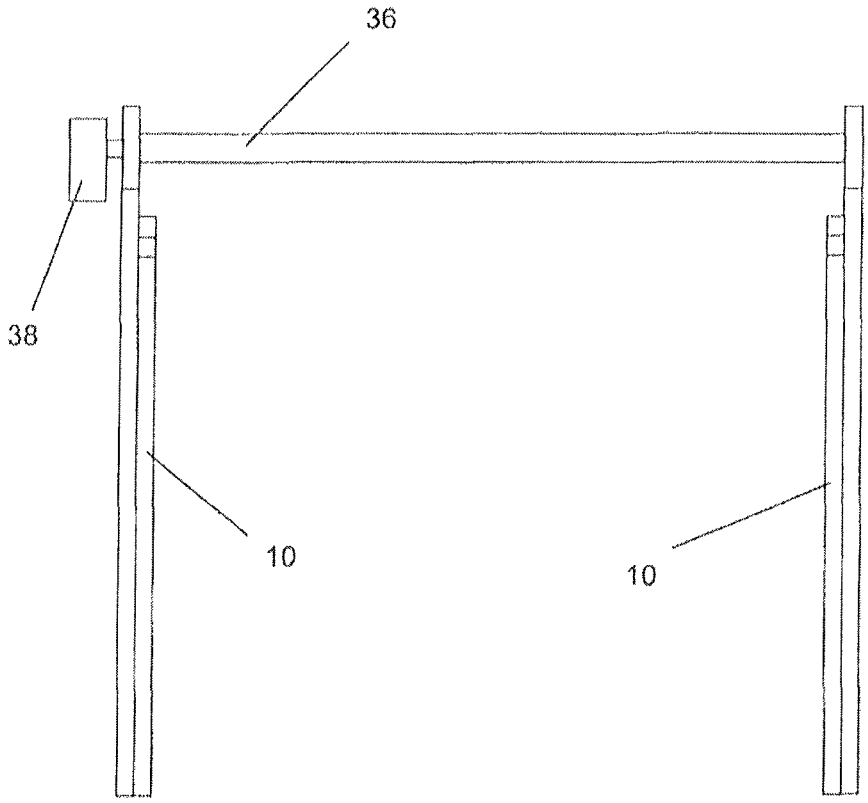
FIG. 2 is a frontal view of an exemplary industrial door assembly, showing the exemplary door jamb of FIG. 1 from a side view.
Figure 3:
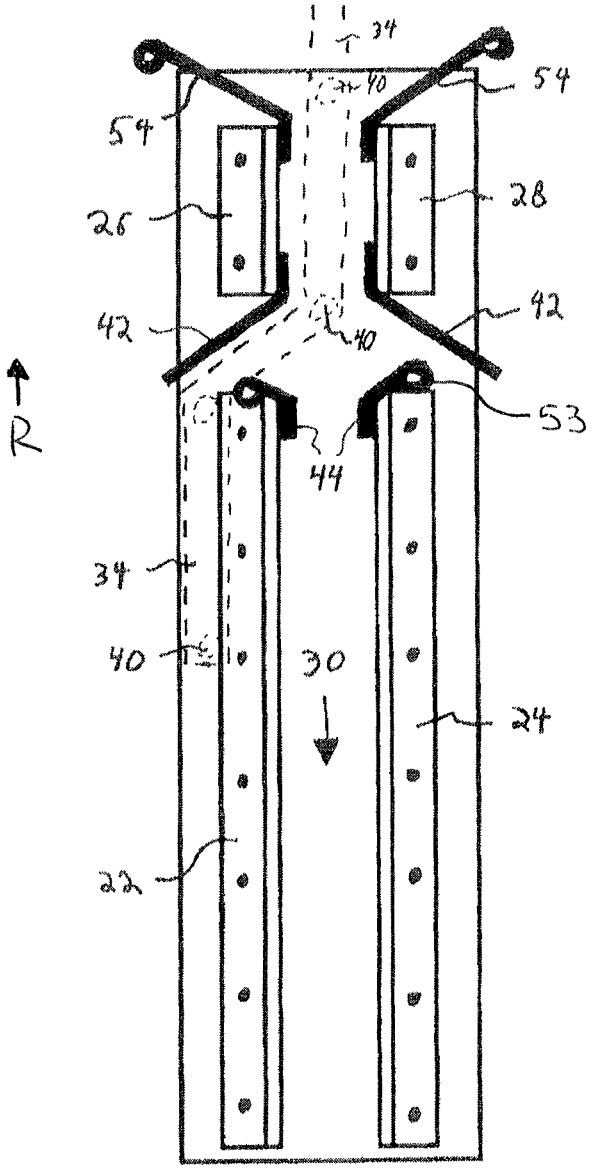
FIG. 3 is a frontal view of the exemplary door jamb of FIG. 1 being utilized to realign an industrial door within the track of the jamb.

Referencing FIGS. 2 and 3, an exemplary industrial door system includes a pair of door jambs 10, an industrial door 34 (see FIG. 3, shown in phantom), and an industrial door roller 36 that is repositioned by a roller motor 38. The door 34 is generally repositioned by the motor 38 engaging the roller 36 to rotate the roller either clockwise or counterclockwise. In this exemplary embodiment, clockwise rotation of the roller 36 is operative to lower the door 34, while counterclockwise rotation of the roller is operative to raise the door. It is to be understood, however, that alternative rotational patterns may be utilized such as, without limitation, using clockwise rotation of the roller 36 to raise the door 34 and counterclockwise rotation of the roller to lower the door.

In exemplary form, the industrial door 34 may comprise a solid paneled door, a flexible fabric/plastic curtain, a combination of the foregoing, or any other type of door operative to retard motion through an opening. In this exemplary embodiment, for purposes of explanation only, the exemplary industrial door 34 is a break-away door comprising a plastic curtain with internal weighted framing 40 to weigh down the curtain and ensure that the curtain drops vertically at approximately the same rate on opposing lateral sides. The weighted framing 40 of the door is also flexible and operative to deform, preferably bow outward, when a predetermined contacting force is applied to the curtain.

By way of explanation only, the exemplary break-away industrial door 34 may be utilized for car washes. In such a circumstance, the curtain may be lowered intermittently at the end of the washing and/or drying cycle between consecutive automobiles. During this upward and downward movement cycle, it is conceivable that the door becomes stuck in the down position and an automobile inadvertently drives into the door or the driver of the automobile is impatient and prematurely exits the car wash by displacing the door. In these circumstances, the frame of the door is adapted to bow outward in the direction of contact, thereby lessening the widthwise or lateral dimension of the door until the widthwise dimension is less than the widthwise dimension between opposite door jambs, thereby resulting in the door frame being expelled from the track. Alternatively, the frame may bow inward toward the interior of the car wash when subjected to strong winds. Thus, the exemplary door jamb 10 takes into account realigning of the door from both the left and right sides.

Referring to FIGS. 1 and 3, each discontinuity 32 cooperates with plastic realigners 42, 44 to automatically realign the industrial door 34 within the track 30 upon raising of the vertical door (direction "R" in FIG. 3). In exemplary form, the discontinuity 32 comprises an eight inch gap between the lower angled brackets 22, 24 and the upper angled brackets 26, 28. The top pair of realigners 42 each comprise three inch wide bar stock fabricated from ultra high molecular weight polyethylene, with a total length of ten inches having a forty-five degree bend inset approximately four inches from one end of the bar stock to provide a vertical portion 46 and an angled portion 48. The vertical portion 46 is mounted to an interior surface of the upper angled brackets 26, 28 defining the track 30, while the angled portion 48 extends outward through the discontinuity 32. In this manner, the realigners 42 cooperate to form a Y-shaped taper that operates to funnel the door back into the track 30 as the door 34 is raised. After the door is sufficiently raised so that all of the door is within the track, given the retracted or partially retracted position of the door 34, the door may be further retracted or may be lowered to a closed position.

In exemplary form, the door 34 is lowered to a closed position after the frame 40 is realigned in the track 30 by the top pair of plastic realigners 42. On the descent of the door 34 (and frame 40), the bottom pair of aligners 44 are operative to ensure that the door 34 does not deviate from the vertical path established by the track 30. In this exemplary embodiment, the bottom pair of realigners 44 each comprise three inch wide bar stock fabricated from ultra high molecular weight polyethylene, with a total length of six inches having a forty-five degree bend inset approximately two inches from one end of the bar stock to provide a vertical portion 50 and an angled portion 52. The vertical portion 50 is mounted to an interior surface of the lower angled brackets 22, 24 defining the track 30, while the angled portion 48 extends outward through the discontinuity 32. An outer end of the angled portion 52 has a curved surface 53 to inhibit the door 34 from snagging on this end as the door is retracted upward, presuming the door is out of the track 30. In this manner, the realigners 44 cooperate to form a Y-shaped taper that operates to maintain the door along its vertical orientation as the door descends within the track 30 and passes beyond the area of the discontinuity 32.

Referring again to FIG. 1, the exemplary door jamb 10 also includes a pair of polymer initial aligners 54 that each comprise three inch wide bar stock fabricated from ultra high molecular weight polyethylene, with a total length of twelve inches and having a forty-five degree bend inset approximately four inches from one end to provide a vertical portion 56 and an angled portion 58. The vertical portion 56 is mounted to an interior surface of the upper angled brackets 26, 28 nearest the door roller 36, while the angled portion 58 extends upward toward the door roller. The angled portion 58 of each aligner 54 is curled to ensure that if the door is completely outside the track 30 and accordingly retracted, the ends of the angled portion will not snag on the door as the door travels there past. In this manner, the aligners 54 serve a dual purpose to allow the door to be rolled up even when it is completely out of its track 30, as well as forming a Y-shaped taper that funnels the door into the track 30 when the door is unrolled.

Figure 4:
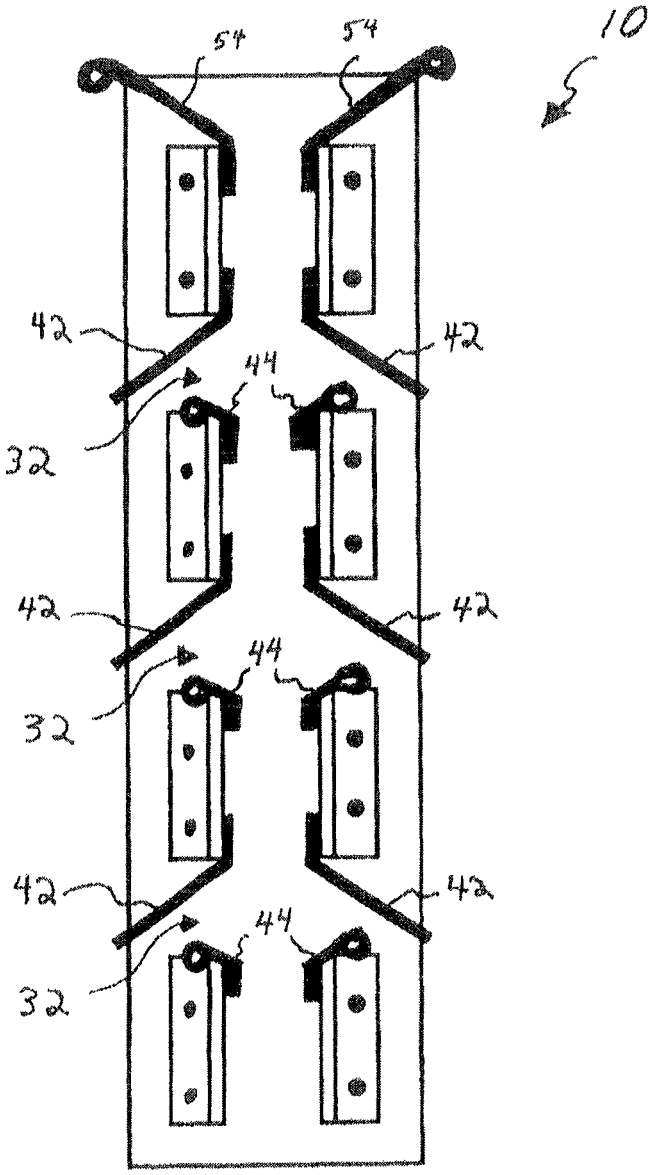
FIG. 4 is a frontal view of an alternate exemplary door jamb fabricated in accordance with the present invention.

Referring to FIG. 4, it is to be understood that while the exemplary door jamb 10 has been shown and described in FIGS. 1-3 with a single discontinuity 32, it is also within the scope of the invention that the door jamb 10 include multiple discontinuities. Each additional discontinuity may include realigners 42, 44 to facilitate repositioning of door 34 back into the track 30, as well as maintaining the framing 40 within the track. Those of ordinary skill will readily understand that the number of discontinuities may depend on a number of factors that include, without limitation, the type of industrial door, the height of the opening closed off by the door, the frequency of travel of the door up and down, the typical repetitive distance traveled by the door, and the dimensions of the discontinuities themselves, which may vary.

While each of the foregoing aligners 44, 54 includes one end that includes a curved surface (such as surface 53 in FIG. 3), it is not a requisite for the end to be curled to fall within the scope of the invention. By way of example, and not limitation, the ends of the aligners 44, 54 may be straight or have a slight bend.

Following from the above description and invention summaries, it should be apparent to those of ordinary skill in the art that, while the methods and apparatus herein described constitute an exemplary embodiment of the present invention, the invention contained herein is not limited to this precise embodiment and that changes may be made to this embodiment without departing from the scope of the invention as defined by the claims. Likewise, it is to be understood that it is not necessary to meet any or all of the identified advantages or objects of the invention disclosed herein in order to fall within the scope of the invention, since the invention is defined by the claims and since inherent and/or unforeseen advantages of the present invention may exist even though they may not have been explicitly discussed herein. Finally, it will be apparent that additional claims may be inherent in the invention and not expressly described herein.

What is claimed is:

1. A door jamb of an overhead roll-up door, the door jamb comprising:

a first pair of substantially parallel brackets, each bracket in the first pair of substantially pair of parallel brackets having an inner surface and an outer surface, the inner surface defining a track along which a door panel moves vertically as it is wound and unwound from a roller;

a second pair of substantially parallel brackets, each bracket in the second pair of substantially parallel brackets having an inner surface and an outer surface, the second pair of substantially parallel brackets being aligned with the first pair of parallel brackets, the second pair of parallel brackets further defining the track and being spaced from the first pair of substantially parallel brackets such that a discontinuity is formed between the first and second pairs of substantially parallel brackets; and, a first pair of realigners attached to the first pair of substantially parallel brackets, each realigner in the first pair of realigners having a first portion connected to the inner surface of one bracket of the first pair of substantially parallel brackets and extending vertically along the track, and a second portion extending outwards from the track through the discontinuity, the second portion extending beyond the outer surfaces of the brackets forming first and second pairs of substantially parallel brackets.

2. The door jamb of claim 1 further comprising a second pair of realigners, each realigner in the second pair of realigners being attached to one bracket of the second pair of substantially parallel brackets, each realigner in the second pair of realigners having a first portion attached to one bracket of the second pair of substantially parallel brackets inside the discontinuity, and a second portion attached to the inner surface of one bracket of the second pair of substantially parallel brackets and extending vertically along the track.

3. The door jamb of claim 2 wherein the first portion of each realigner of the second pair of realingers further includes a curved surface.

4. The door jamb of claim 3 wherein the curved surface is of each realigner in the second pair of realigners attaches to one bracket of the second pair of substantially parallel brackets inside the discontinuity.

5. The door jamb of claim 2 wherein the first and second pairs of realigners are formed from ultra-high molecular weight polymers.

6. The door jamb of claim 2 further comprising a third pair of realigners, the third pair of realigners being attached to the first pair of substantially parallel brackets, each realigner of the third pair of realigners having a first portion attached to the inner surface of one bracket of the first pair of substantially parallel brackets and extending vertically along the track, and a second portion extending above the first pair of substantially parallel brackets and the track.

7. The door jamb of claim 6 wherein the second portion of each realigner of the third pair of realigners extends outwards from the track at an angle to the track.

8. The door jamb of claim 7 wherein the second portion of each realigner of the third pair of realigners extends outward from the track beyond the outer surface of the first pair of substantially parallel brackets.

9. The door jamb of claim 6 wherein the first portion of the first pair of realigners, the second portion of the second pair of realigners, and the first portion of the third pair of realigners each narrow a portion of the track defined by the first and second pairs of realigners along which the door panel moves vertically.

10. The door jamb of claim 1 wherein the first and second pairs of substantially parallel brackets are made of fiberglass.

11. A door jamb of an overhead roll-up door, the door jamb comprising:

a first pair of substantially parallel brackets, the first pair of substantially parallel brackets having a first bracket and a second bracket each having an inner surface and an outer surface, the inner surfaces of the first and the second brackets defining a track along which a door panel moves vertically as it is wound and unwound from a roller;

a second pair of substantially parallel brackets, the second pair of substantially parallel brackets having a third bracket and fourth bracket each having an inner surface and an outer surface, the second pair of substantially parallel brackets being aligned with the first pair of substantially parallel brackets so that the inner surfaces of the third and fourth brackets further define the track along which the door panel moves vertically, the second pair of substantially parallel brackets being spaced apart from the first pair of substantially parallel brackets such that a discontinuity is formed between the first and second pairs of substantially parallel brackets; and, a first pair of realigners, the first pair of realigners having a first realigner and a second realigner, wherein the first and second realigners each have a first portion attached to the inner surface of one of the first or second brackets and extending vertically along the track, wherein the first portion of one of the first and second realigners attaches to the first bracket and the first portion of one of the first and second realigners attaches to the second bracket, and a second portion extending outwards from the track through the discontinuity, the second portion extending beyond the outer surfaces of the first, second, third, and fourth brackets.

12. The door jamb of claim 11 further comprising a second pair of realigners, the second pair of realigners having a third realigner and a fourth realigner, wherein the third realigner and the fourth realigner each have a first portion attached to one of the third and fourth brackets inside the discontinuity, and a second portion attached to the inner surface of one of the third and fourth brackets and extending vertically along the track, wherein the first and second portion of one the third or fourth realigners attaches to the third bracket and the first and second portion of one of the third or fourth realigners attaches to the fourth bracket.

13. The door jamb of claim 12 wherein the first portion of the third and fourth realingers each include a curved surface.

14. The door jamb of claim 12 wherein the first, second, third, and fourth realigners are formed from ultra-high molecular weight polymers.

15. The door jamb of claim 12 further comprising a third pair of realigners, the third pair of realigners having a fifth and a sixth realigner, the fifth realigner and sixth realigner each having a first portion attached to the inner surface of one of the first and second brackets, the first portion extending vertically along the track wherein the first portion of one the fifth and sixth realigners attaches to the first bracket and the first portion of one of the fifth and sixth realigners attaches to the second bracket, and a second portion extending above the first and second brackets.

16. The door jamb of claim 15 wherein the second portion of the fifth and sixth realigners extends at an angle outward from the track above the first and second brackets.

17. The door jamb of claim 16 wherein the second portion of the fifth and sixth realigners extends outward beyond the outer surface of the first and second brackets.

18. The door jamb of claim 15 wherein the first portion of the first and second realigners, the second portion of the third and fourth realigners, and the first portion of the fifth and sixth realigners each narrow a portion of the track along which the door panel moves vertically.

19. The door jamb of claim 11 wherein the first, second, third, and fourth brackets are made of fiberglass.

* * * * *